US009954299B2

(12) United States Patent
Kiryu et al.

(10) Patent No.: US 9,954,299 B2
(45) Date of Patent: Apr. 24, 2018

(54) CONNECTOR AND METHOD OF CONNECTING CONNECTOR

(71) Applicant: FUJITSU COMPONENT LIMITED, Tokyo (JP)

(72) Inventors: Koichi Kiryu, Nagano (JP); SeungSeok Beak, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 223 days.

(21) Appl. No.: 13/855,154

(22) Filed: Apr. 2, 2013

(65) Prior Publication Data

US 2013/0263448 A1 Oct. 10, 2013

(30) Foreign Application Priority Data

Apr. 4, 2012 (JP) ..... 2012-085937

(51) Int. Cl.
*H01R 13/24* (2006.01)
*H01R 12/71* (2011.01)

(52) U.S. Cl.
CPC ..... *H01R 13/2428* (2013.01); *H01R 12/714* (2013.01); *Y10T 29/49204* (2015.01)

(58) Field of Classification Search
CPC ... H01R 13/22–13/2492; H01R 12/714; H01R 12/712
USPC ..... 439/66, 862, 500
See application file for complete search history.

(56) References Cited

U.S. PATENT DOCUMENTS

| | | | | |
|---|---|---|---|---|
| 5,904,580 | A * | 5/1999 | Kozel | H01R 12/52 439/66 |
| 6,113,440 | A | 9/2000 | Fijten et al. | |
| 6,293,806 | B1 * | 9/2001 | Yu | 439/66 |
| 7,147,489 | B1 * | 12/2006 | Lin | H01R 12/57 439/83 |
| 7,422,493 | B2 * | 9/2008 | Wang et al. | 439/862 |
| 7,563,104 | B2 * | 7/2009 | Kim | H01R 12/58 439/66 |
| 2005/0181638 | A1 * | 8/2005 | Mowry | H01R 11/03 439/66 |

FOREIGN PATENT DOCUMENTS

| | | | |
|---|---|---|---|
| JP | 11-250966 | | 9/1999 |
| JP | 2006164682 | A * | 6/2006 |
| JP | 2007-501498 | | 1/2007 |

(Continued)

*Primary Examiner* — Livius R Cazan
(74) *Attorney, Agent, or Firm* — IPUSA, PLLC

(57) ABSTRACT

A connector configured to make a contact with an electrical apparatus includes a contact formed of a metal material; and a housing that houses the contact. The contact includes an exposed part that is exposed outside the housing, a contact portion provided in the exposed part and configured to come into contact with an electrode of the electrical apparatus, and a projecting part provided in the exposed part and positioned between the contact portion and the housing. The housing includes an exterior wall that forms a surface of the housing that faces the electrode. The exterior wall and the projecting part are configured to be in contact with each other when the electrode and the contact portion come into contact with each other to establish an electrical connection between the contact and the electrode.

18 Claims, 11 Drawing Sheets

(56) References Cited

FOREIGN PATENT DOCUMENTS

| | | |
|---|---|---|
| JP | 2008-166198 | 7/2008 |
| JP | 2008-218035 | 9/2008 |
| WO | 2005/013430 | 2/2005 |

* cited by examiner

CONNECTOR AND METHOD OF CONNECTING CONNECTOR

CROSS-REFERENCE TO RELATED APPLICATION

The present application is based upon and claims the benefit of priority of Japanese Patent Application No. 2012-085937, filed on Apr. 4, 2012, the entire contents of which are incorporated herein by reference.

BACKGROUND OF THE INVENTION

1. Field of the Invention

The present invention relates to a connector and a method of connecting a connector.

2. Description of the Related Art

Portable electronic apparatuses such as cellular phones include a battery. The battery is charged by causing electrodes of the battery to come into contact with a battery connector provided in a charger. Usually, such a battery connector includes a connector housing and contacts that have a spring characteristic and project on the contact surface side of the connector housing. By pressing the electrodes of the battery against the contacts, the contacts are displaced against the spring resilience. The contacts are pressed against the electrodes of the battery by the resilience generated by such displacement of the contacts, so that the contact of the contacts with the electrodes of the battery is maintained.

Reference may be made to, for example, Japanese Laid-Open Patent Application Nos. 2008-218035, 2008-166198, and 11-250966 for related art.

SUMMARY OF THE INVENTION

According to an aspect of the present invention, a connector configured to make a contact with an electrical apparatus includes a contact formed of a metal material; and a housing that houses the contact, wherein the contact includes an exposed part that is exposed outside the housing; a contact portion provided in the exposed part and configured to come into contact with an electrode of the electrical apparatus; and a projecting part provided in the exposed part and positioned between the contact portion and the housing, wherein the housing includes an exterior wall that forms a surface of the housing that faces the electrode, and wherein the exterior wall and the projecting part are configured to be in contact with each other when the electrode and the contact portion come into contact with each other to establish an electrical connection between the contact and the electrode.

According to an aspect of the present invention, a method of connecting a connector to an electrical apparatus includes causing an electrode of the electrical apparatus to come into contact with a contact portion of a contact of the connector, wherein the contact is formed of a metal material and the contact portion is provided in an exposed part of the contact exposed outside a housing of the connector that houses the contact; causing an exterior wall of the housing and a projecting part of the connector to come into contact with each other by causing the electrode to press the contact portion after said causing the electrode to come into contact with the contact portion, wherein the exterior wall forms a surface of the housing that faces the electrode, and wherein the projecting part is provided in the exposed part and positioned between the contact portion and the housing; and causing the contact portion to move on a surface of the electrode while being supported on points of contact of the exterior wall and the projecting part by causing the electrode to further press the contact portion after said causing the exterior wall and the projecting part to come into contact with each other.

DESCRIPTION OF THE EMBODIMENTS

Figure 1:
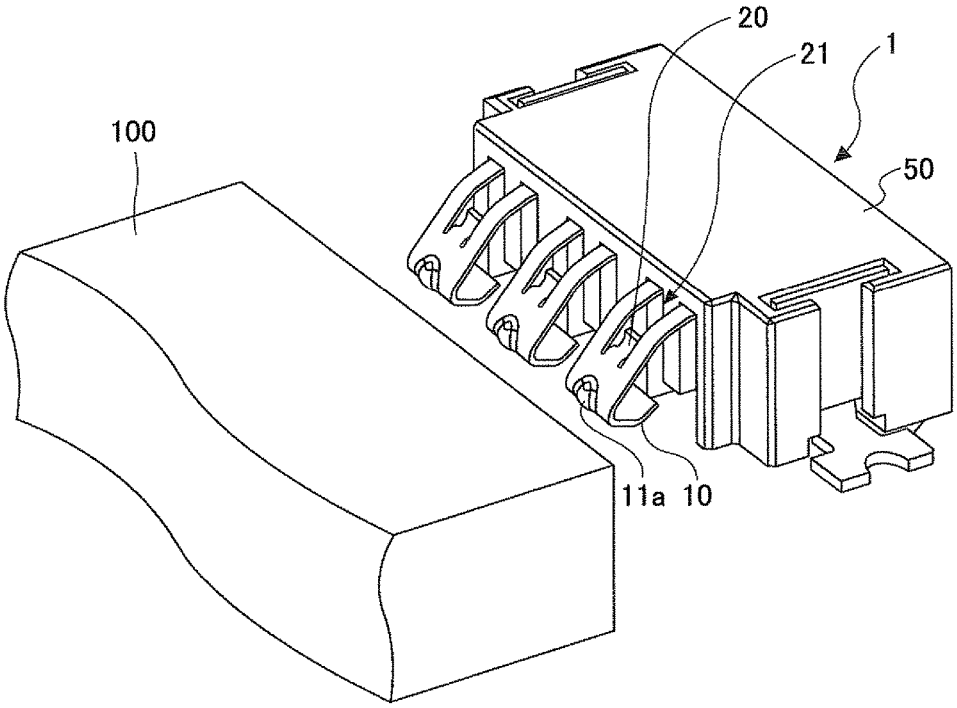
FIG. 1 is a perspective view of a connector according to an embodiment.

A description is given below, with reference to the accompanying drawings, of an embodiment of the present invention. In the drawings, the same elements are referred to by the same reference numerals, and their description is omitted.

It is not easy to remove a metal oxide film or the like formed on the surfaces of the electrodes of a battery, and a mere contact of the contacts of a connector and the electrodes of the battery is not sufficient to remove the metal oxide film. Accordingly, in order to remove the metal oxide film formed on the surfaces of the electrodes of the battery, it is desirable to scrape (wipe) off the metal oxide film with a strong force with the contacts of the connector. However, such a strong force is not obtained sufficiently with the resilience of a spring characteristic of the contacts having a conventional structure.

Further, in removing the metal oxide film formed on the electrodes of the battery, it is preferable to cause the positions of the points of contact of the contacts with the electrodes of the battery to make a relatively large movement. That is, when the movements of the positions of the points of contact of the contacts with the electrodes of the battery are limited, the metal oxide film formed on the surfaces of the electrodes of the battery is merely pressed without being scraped off, thus remaining on the surfaces of the electrodes of the battery. The metal oxide film thus remaining on the surfaces of the electrodes of the battery prevents electrical conduction from being sufficiently established between the electrodes of the battery and the contacts.

Accordingly, in order to remove a metal oxide film formed on the surfaces of the electrodes of a battery, it is preferable that the contact positions of contacts be allowed to make a relatively large movement while the contacts are pressed against the surfaces of the electrodes of the battery with a large force.

[Connector Structure]

Figure 2:
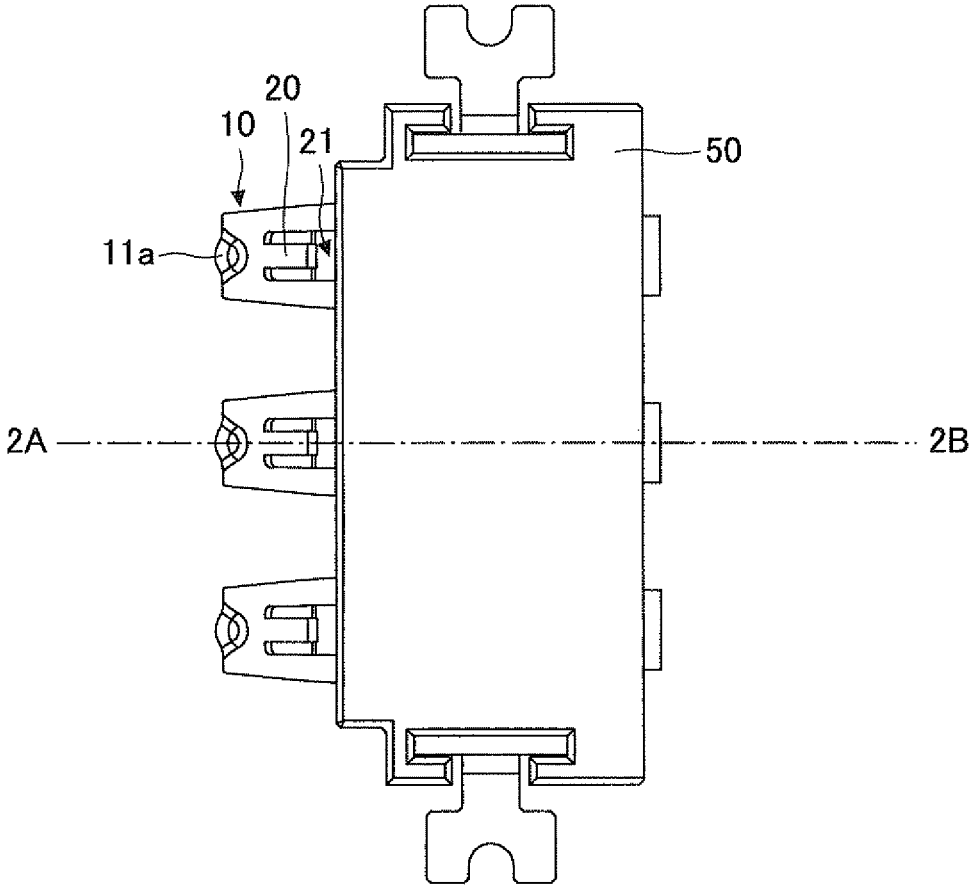
FIG. 2 is a plan view of the connector according to the embodiment.
Figure 3:
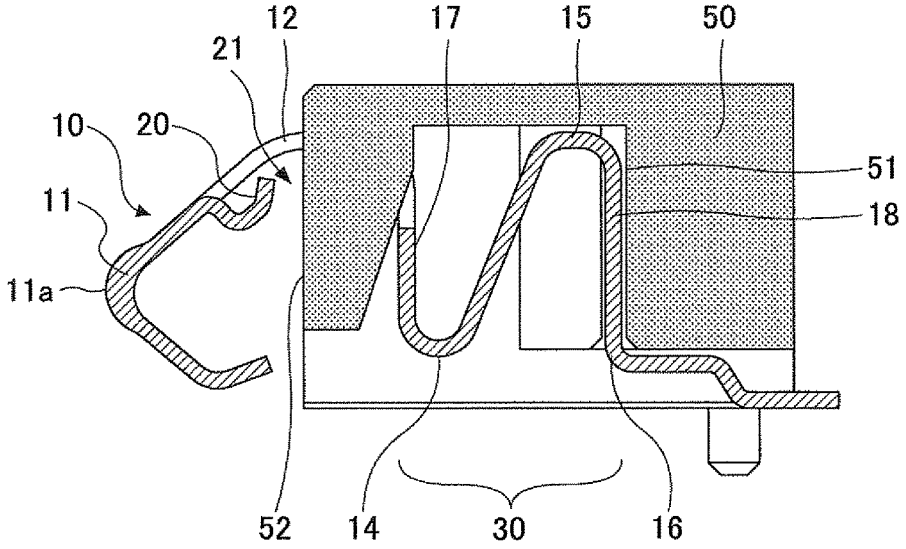
FIG. 3 is a cross-sectional view of the connector according to the embodiment.
Figure 4:
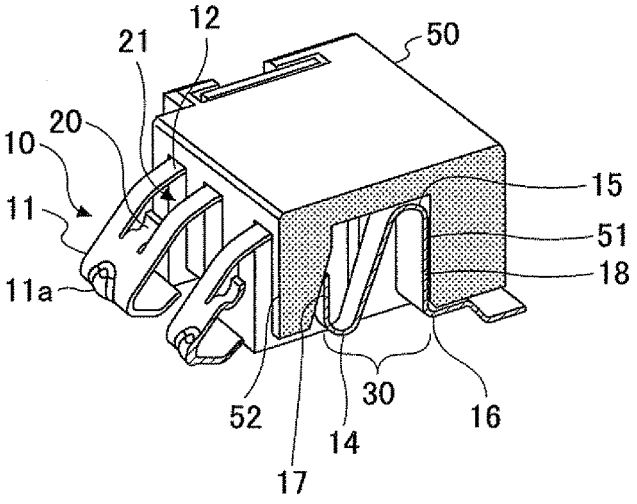
FIG. 4 is a perspective view of the connector according to the embodiment.
Figure 5:
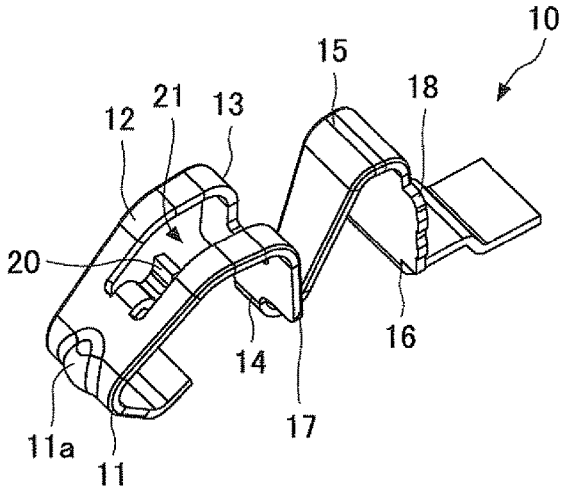
FIG. 5 is a perspective view of a contact part of the connector.
Figure 6:
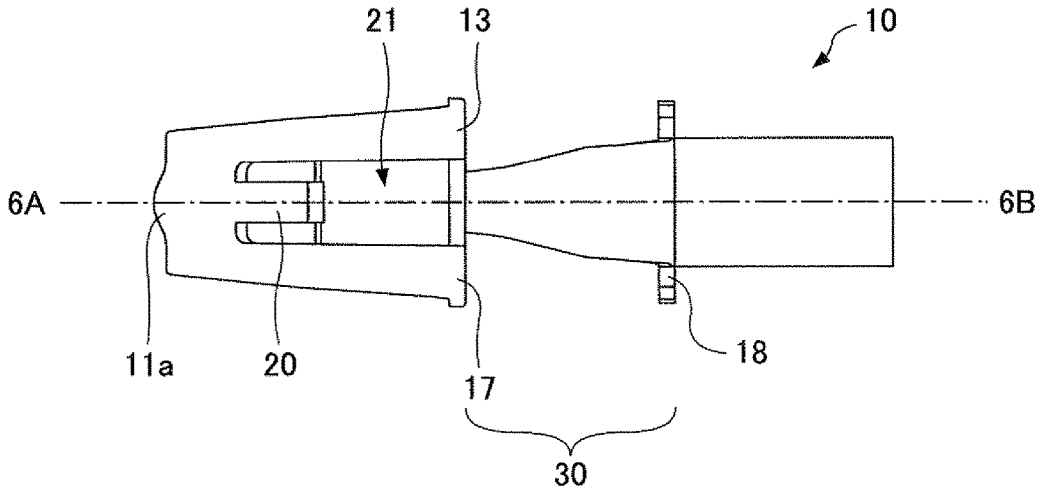
FIG. 6 is a plan view of the contact part of the connector.
Figure 7:
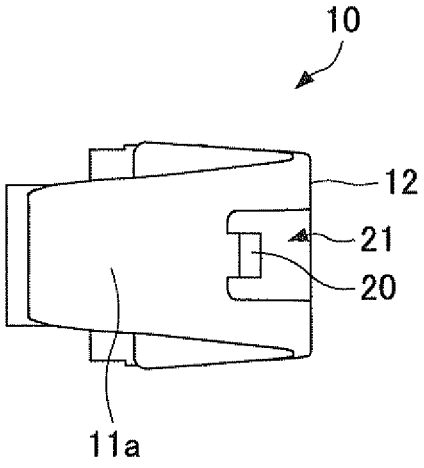
FIG. 7 is a front view of the contact part of the connector.
Figure 8:
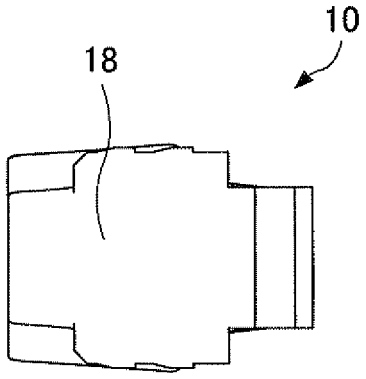
FIG. 8 is a rear view of the contact part of the connector.
Figure 9:
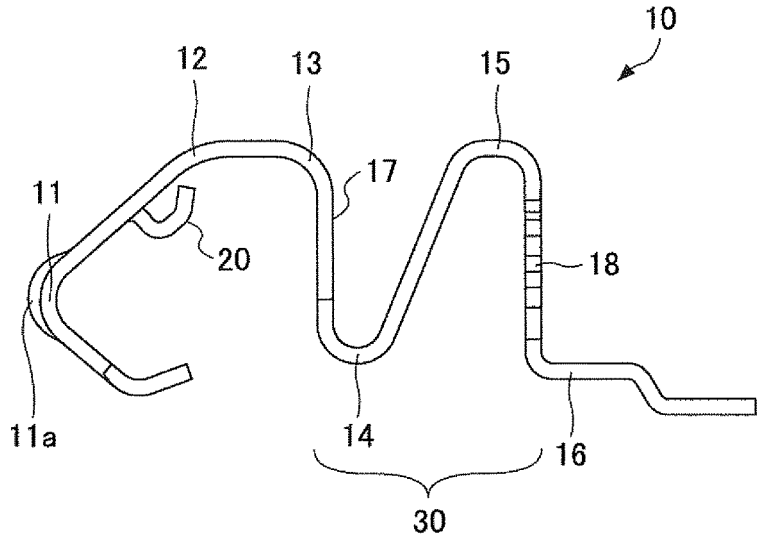
FIG. 9 is a right side view of the contact part of the connector.
Figure 10:
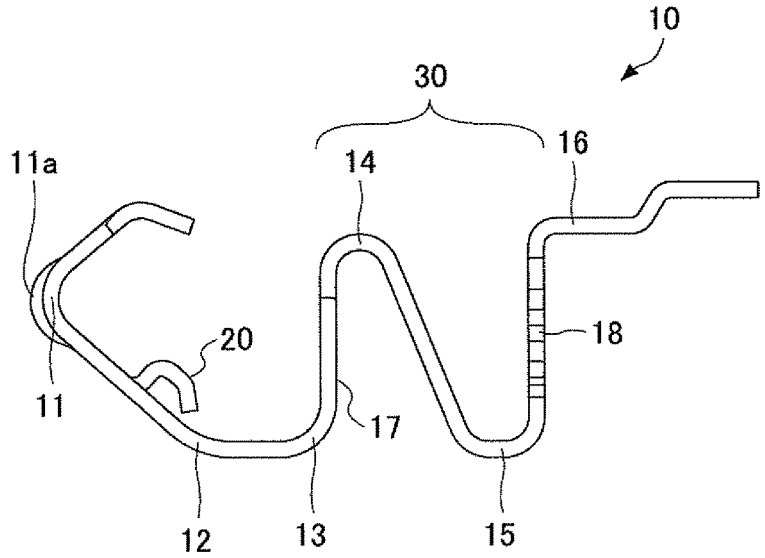
FIG. 10 is a left side view of the contact part of the connector.
Figure 11:
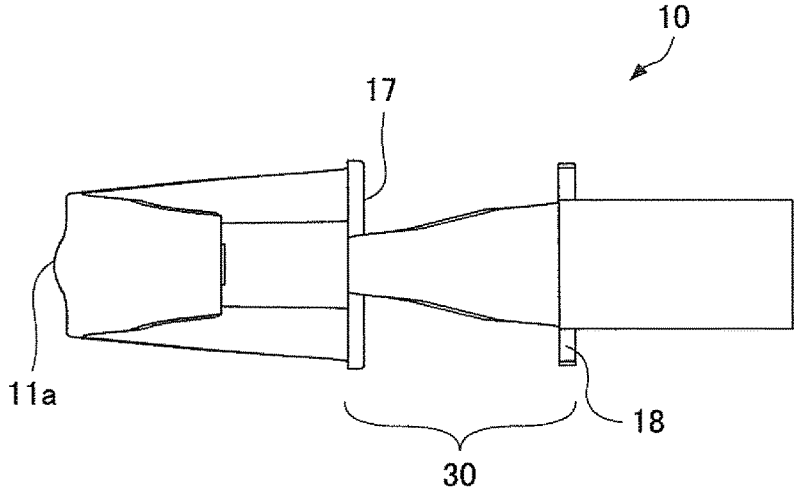
FIG. 11 is a bottom view of the contact part of the connector.

Next, a description is given, with reference to FIG. 1 through FIG. 4, of a connector according to this embodiment. A connector 1 of this embodiment, which is of a type called a battery connector, is used to charge a battery 100 of a cellular phone or the like by supplying the battery 100 with electric power while the connector is in contact with electrodes (not graphically illustrated) of the battery 100. FIG. 1 and FIG. 2 are a perspective view and a plan view, respectively, of the connector 1 according to this embodiment. FIG. 3 is a cross-sectional view of the connector 1, taken along a plane including a one-dot chain line 2A-2B in FIG. 2. FIG. 4 is a perspective view of the connector 1 sectioned along a plane including the one-dot chain line 2A-2B in FIG. 2. In this embodiment, the battery 100 may also be referred to as an "electrical apparatus."

The connector 1 of this embodiment includes multiple (three in the illustrated case) contact parts 10 and a housing part 50 that is formed to partially cover the contact parts 10. The contact parts 10 are formed of a metal material having electrical conductivity and elasticity, such as a material including copper (Cu). Hereinafter, the contact parts 10 may also be collectively referred to as the "contact part 10" when no distinction is made between them. The contact part 10 includes a contact portion 11*a* that comes into contact with a corresponding electrode (not graphically illustrated) of the battery 100. Further, the contact part 10 includes a projecting part 20 and an opening 21 formed by removing part of the metal material around the projecting part 20. The housing part 50 is formed of an insulator, for example, a resin material.

Figure 12:
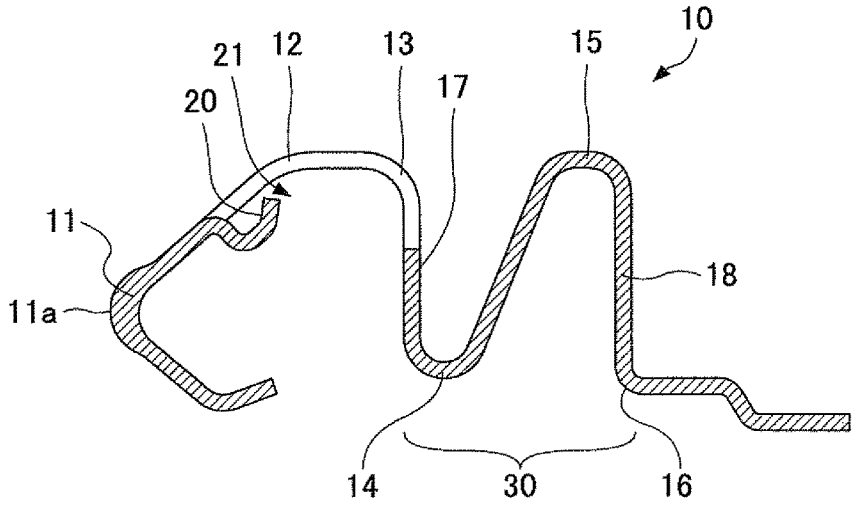
FIG. 12 is a cross-sectional view of the contact part of the connector.

A description is given, with further reference to FIG. 5 through FIG. 12, of the contact part 10. FIG. 5, FIG. 6, FIG. 7, FIG. 8, FIG. 9, FIG. 10, and FIG. 11 are a perspective view, a plan view, a front view, a rear view, a right side view, a left side view, and a bottom view, respectively, of the contact part 10. FIG. 12 is a cross-sectional view of the contact part 10, taken along a plane including a one-dot chain line 6A-6B in FIG. 6.

According to the connector 1 of this embodiment, the contact part 10 is formed by performing processing such as piercing and bending on a flat copper plate or the like. The contact part 10 includes a first bent part 11, a second bent part 12, a third bent part 13, a fourth bent part 14, a fifth bent part 15, and a sixth bent part 16, which are formed by bending a copper plate that forms the contact part 10.

The first bent part 11 is formed by bending the copper plate toward a first surface of the copper plate. The contact portion 11*a* that comes into contact with an electrode of the battery 100 is formed in a bent portion of the first bent part 11. The contact portion 11*a* has an uneven surface so as to facilitate removal of a metal oxide film formed on the surface of the electrode of the battery 100.

The second bent part 12 and the third bent part 13 are formed by bending the copper plate toward the first surface of the copper plate. The fourth bent part 14 is formed by bending the copper plate toward a second surface of the copper plate facing away from the first surface. The fifth bent part 15 is formed by bending the copper plate toward the first surface of the copper plate. The sixth bent part 16 is formed by bending the copper plate toward the second surface of the copper plate.

The contact part 10 includes a first flat part 17 formed between the third bent part 13 and the fourth bent part 14. After coming into contact with the electrode of the battery 100, the contact portion 11*a* is pressed toward the first flat part 17.

The contact part 10 includes a second flat part 18 formed between the fifth bent part 15 and the sixth bent part 16. The second flat part 18 is substantially parallel to the first flat part 17. Thus, the first flat part 17, the fourth bent part 14, the fifth bent part 15, and the second flat part 18 form a Z-letter shape (see, for example, FIG. 10). Therefore, this Z-shaped part of the copper plate may be caused to serve as a spring. Accordingly, it is possible to increase resilience that works on the first flat part 17 and the second flat part 18 in a direction substantially normal to the first flat part 17 and the second flat part 18. The Z-shaped part of the contact part 10, formed by the first flat part 17, the fourth bent part 14, the fifth bent part 15, and the second flat part 18, may be referred to as a "contact spring part 30."

Further, the projecting part 20 is provided between the first bent part 11 and the second bent part 12. The projecting part 20 is formed by separating part of the copper plate from its surrounding part by piercing or the like and thereafter bending the separated part so that the separated part projects toward the first surface of the copper plate. In this embodiment, the opening 21 is formed in part of the periphery of the projecting part 21 by piercing or the like.

As illustrated in FIG. 1 through FIG. 4, in the connector 1 of this embodiment, the contact part 10 is provided with its portion continuing from the second bent part 12 in which the first bent part 11 is formed, that is, the first bent part 11 and the projecting part 20, being exposed outside the housing part 50. A housing part interior wall 51 is provided in the housing part 50. When the contact portion 1*a* of the contact part 10 is pressed by the electrode of the battery 100, the housing part interior wall 51 comes into contact with the second flat part 18 of the contact part 10.

When the contact portion 11*a* of the contact part 10 is further pressed by the electrode of the battery 100 while the second flat part 18 is in contact with the housing part interior wall 51, the distance between the first flat part 17 and the second flat part 18 is reduced, so that a resilience is generated in the contact part 10. The contact portion 11*a* of the contact part 10 is pressed toward the electrode of the battery 100 by a strong force due to this resilience. Further, the housing part 50 includes a housing part exterior wall 52 that faces the electrode of the battery 100. As described below, when the contact portion 11*a* of the contact part 10 is pressed by the electrode of the battery 100, the projecting part 20 comes into contact with the housing part exterior wall 52.

[Method of Connecting to Battery Electrode]

Next, a description is given of a method of connecting a connector to the electrodes of a battery according to this embodiment.

Figure 13:
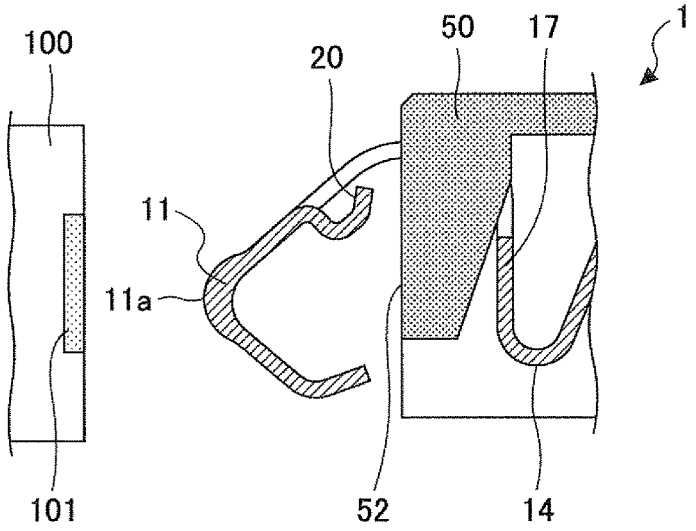
FIG. 13 is a diagram illustrating a method of connecting a connector and a battery according to the embodiment.

First, as illustrated in FIG. 13, when an electrode 101 of the battery 100 is out of contact with the contact portion 11*a* of the contact part 10 of the connector 1 of this embodiment, no resilience is generated in the contact part 10. Further, in the housing part 50, the housing part exterior wall 52, which is a surface that faces the electrode 101 of the battery 100, is out of contact with the projecting part 20 of the contact part 10.

Figure 14:
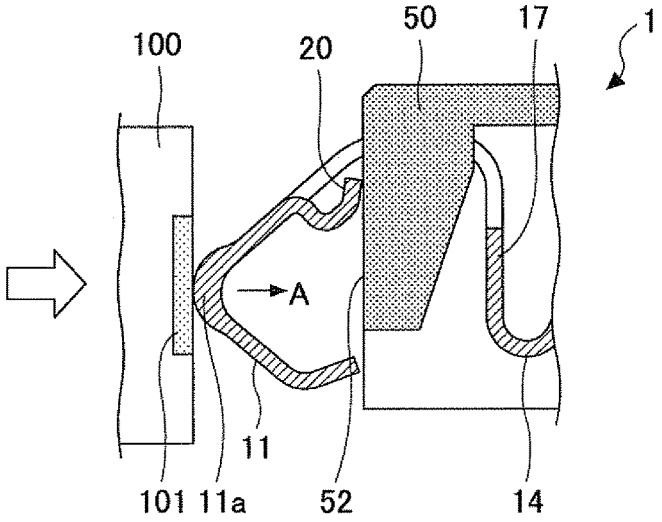
FIG. 14 is another diagram illustrating the method of connecting a connector and a battery according to the embodiment.

Next, as illustrated in FIG. 14, the electrode 101 of the battery 100 comes into contact with the contact portion 11*a* of the contact part 10 of the connector 1 of this embodiment to press the contact portion 11*a*, so that the contact portion 11*a* is displaced in a direction indicated by arrow A to cause the exposed part of the contact part 10 outside the housing part 50 to move in the direction indicated by arrow A (that is, to cause the contact part 10 to deform or contract in the direction indicated by arrow A). Thereafter, the contact part 10 is further pressed by the electrode 101 of the battery 10, so that a resilience is generated in the contact part 10. A force is applied to the electrode 101 of the battery 100 via the contact portion 11*a* of the contact part 10 by this resilience. The contact portion 11*a* is displaced in the direction indicated by arrow A until the projecting part 20 of the contact part 10 comes into contact with the housing part exterior wall 52 of the housing part 50.

Figure 15:
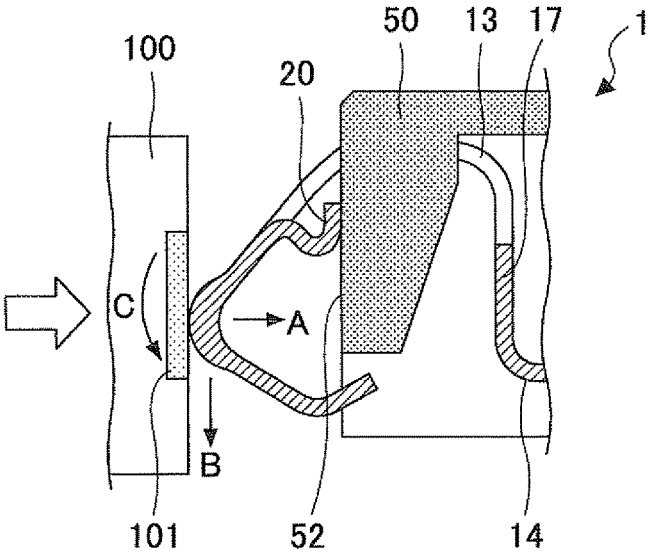
FIG. 15 is another diagram illustrating the method of connecting a connector and a battery according to the embodiment.

Next, as illustrated in FIG. 15, the contact portion 11*a* of the contact part 10 is further pressed by the electrode 101 of the battery 100, so that the projecting part 20 of the contact part 10 comes into contact with the housing part exterior wall 52. As a result, the contact portion 11*a* is displaced (turned) in a direction indicated by arrow C around the points of contact of the projecting part 20 and the housing part exterior wall 52. That is, the contact portion 11*a* of the contact part 10 is further pressed by the electrode 101 of the battery 100, so that the contact portion 11*a* is displaced in a direction indicated by arrow B, which is a direction along the surface of the electrode 101 of the battery 100, while being displaced in the direction indicated by arrow A. The direction indicated by arrow B is substantially perpendicular to the direction indicated by arrow A.

Thus, the contact portion 11*a* of the contact part 10 is caused to move while pressing the surface of the electrode 101 of the battery 100 with a strong force. Therefore, it is possible for the contact portion 11*a* to scrape off and remove a metal oxide film formed on the surface of the electrode 101 of the battery 100 and to expose the metal surface of the electrode 101. This makes it possible to cause metal portions to come into contact with each other between the electrode 101 of the battery 100 and the contact portion 11*a* of the contact part 10. Therefore, it is possible to establish sufficient electrical conduction between the electrode 101 of the battery 100 and the contact part 10.

According to this embodiment, the distance is short between a point of contact where the housing part exterior wall 52 and the projecting part 20 come into contact and a point of contact where the electrode 101 of the battery 100 and the contact portion 11*a* of the contact part 10 come into contact. Therefore, the contact part 10 deforms in the short distance between the projecting part 20 and the contact portion 11*a*, so that a strong resilience is generated. This makes it possible to cause the contact portion 11*a* of the contact part 10 to move while pressing the surface of the electrode 101 of the battery 100 with a strong force. Therefore, according to the connector 1 of this embodiment, it is possible to remove a metal oxide film formed on the surface of the electrode 101 of the battery 100 with more reliability, so that it is possible to make the contact of the electrode 101 of the battery 100 with the contact part 10 more reliable.

[Other Connector]

Next, a description is given of another connector according to this embodiment. The above description is given of the connector 1 where the projecting part 20 is provided in the contact part 10, while according to another connector of this embodiment, a projecting part may be provided in a housing part instead of a contact part.

Figure 16:
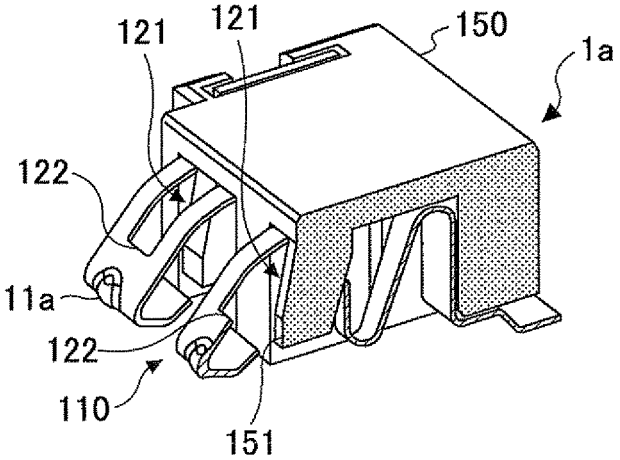
FIG. 16 is a perspective view of another connector according to the embodiment.
Figure 17:
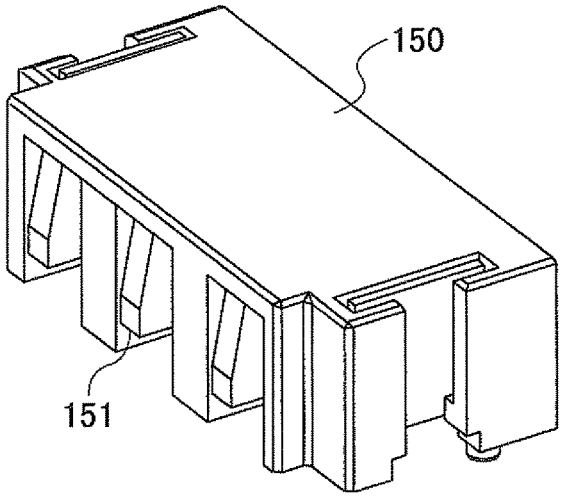
FIG. 17 is a perspective view of a housing part of the connector of FIG. 16 according to the embodiment.
Figure 18:
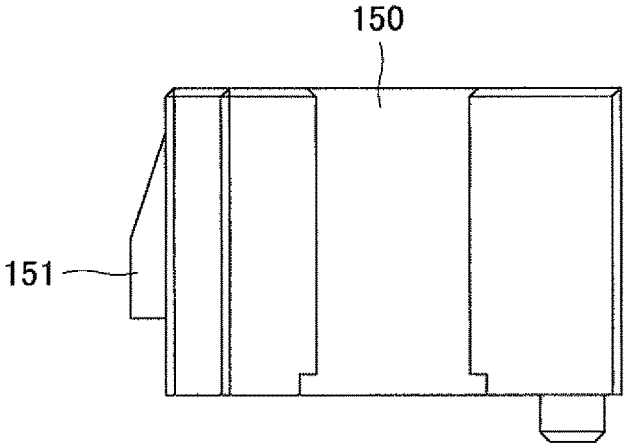
FIG. 18 is a side view of the housing part of the connector according to the embodiment.
Figure 19:
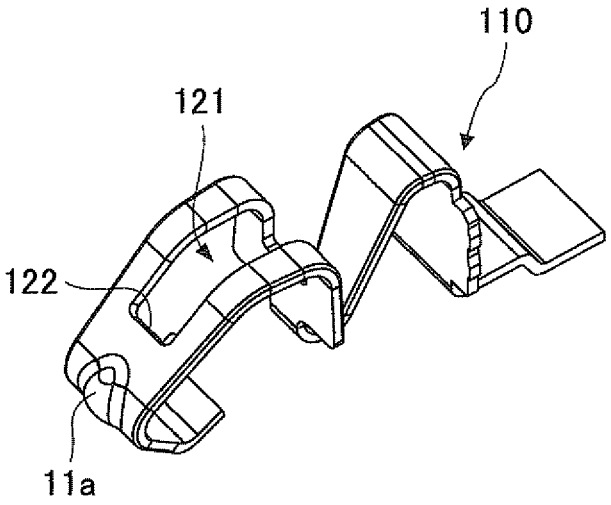
FIG. 19 is a perspective view of a contact part of the connector according to the embodiment.

For example, as illustrated in FIG. 16 through FIG. 19, another connector 1*a* according to this embodiment may include multiple contact parts 110, in each of which no part corresponding to a projecting part is formed in an opening 121, and a housing part 150 including projecting parts 151. FIG. 16 is a perspective view of the connector 1*a*. FIG. 17 and FIG. 18 are a perspective view and a side view, respectively, of the housing part 150. FIG. 19 is a perspective view of the contact part 110.

In this connector 1*a* as well, each contact part 110 is pressed by a battery (not graphically illustrated) via the contact portion 11*a*, so that an edge part 122 of the contact part 110 in the opening 121 comes into contact with the corresponding projecting part 151 of the housing part 150 and the contact part 110 is bent between the edge part 122 and the contact portion 11*a*. This produces the same effects as in the case of the connector 1 where the projecting part 20 is provided in the contact part 10.

The above description is given of the case where a connector is a battery connector, while a connector according to this embodiment may be used for connectors other than the battery connector.

All examples and conditional language provided herein are intended for pedagogical purposes of aiding the reader in understanding the invention and the concepts contributed by the inventors to further the art, and are not to be construed as limitations to such specifically recited examples and conditions, nor does the organization of such examples in the specification relate to a showing of the superiority or inferiority of the invention. Although one or more embodiments of the present invention have been described in detail, it should be understood that the various changes, substitutions, and alterations could be made hereto without departing from the spirit and scope of the invention.

What is claimed is:

1. A connector configured to make a contact with an electrical apparatus, the connector comprising:

a contact formed of a metal material; and a housing that is formed of an insulator and houses the contact, wherein the contact includes:

a housed part that is housed inside the housing, the housed part having a spring characteristic to serve as a spring in the housing, the housed part including:

a first flat part;

a second flat part substantially parallel to the first flat part; and an intermediate part extending obliquely between the first flat part and the second flat part, the intermediate part including a first end from which the first flat part extends and a second end from which the second flat part extends, the first end and the second end being bent in opposite directions;

an exposed part that is exposed outside the housing through a flat exterior surface of the housing;

a contact portion provided in the exposed part and configured to come into contact with an electrode of the electrical apparatus; and a projecting part provided in the exposed part and projecting from a portion of the contact between the housed part and the contact portion toward the exterior surface to have a free end positioned between the contact portion and the exterior surface, wherein the housed part is positioned across the exterior surface from the projecting part, the projecting part is configured to come into contact with the exterior surface when the electrode comes into contact with the contact portion so as to press the contact portion toward the exterior surface, and the contact portion is configured to move around points of contact of the projecting part and the exterior surface when the electrode further presses the contact portion toward the exterior surface while the projecting part is in contact with the exterior surface.

2. The connector as claimed in claim 1, wherein the contact portion is configured to move on a surface of the electrode with the exterior surface and the projecting part being in contact with each other.

3. The connector as claimed in claim 1, wherein the contact is configured to have a resilience generated therein between the contact portion and the projecting part with the exterior surface and the projecting part being in contact with each other.

4. The connector as claimed in claim 1, wherein the connector is configured to make the contact with a battery.

5. The connector as claimed in claim 1, wherein the projecting part is configured to be at a first position where the projecting part is out of contact with the exterior surface before the electrode contacts and presses the contact portion, and to move from the first position to a second position where the projecting part contacts the exterior surface in response to the electrode contacting and pressing the contact portion.

6. The connector as claimed in claim 1, wherein the exposed part includes a first portion and a second portion that are separated by an opening, and the projecting part is positioned in the opening.

7. The connector as claimed in claim 1, wherein the exposed part is exposed outside the housing through an opening formed in the exterior surface of the housing.

8. The connector as claimed in claim 1, wherein the housed part is bent to be deformable in the housing.

9. The connector as claimed in claim 1, wherein the housed part has resilience that works in a direction in which the first flat part and the second flat part face each other across the intermediate part.

10. A connector configured to make a contact with an electrode provided on an electrical apparatus, the connector comprising:

a housing that includes an exterior surface; and a contact that is made of a single metal plate including a first surface and a second surface opposite to each other, and is housed in the housing, wherein the contact includes:

a first portion housed inside the housing, the first portion having a spring characteristic to serve as a spring in the housing, the first portion including:

a first flat part;

a second flat part substantially parallel to the first flat part; and an intermediate part extending obliquely between the first flat part and the second flat part, the intermediate part including a first end from which the first flat part extends and a second end from which the second flat part extends, the first end and the second end being bent in opposite directions;

a contact portion exposed outside the housing, and configured to have the first surface come into contact with the electrode; and a second portion exposed outside the housing, and projecting from a portion of the contact between the first portion and the contact portion toward the exterior surface to have a free end positioned between the exterior surface and the contact portion, wherein the first portion is positioned across the exterior surface from the second portion, the second portion is configured to have the second surface come into contact with the exterior surface in a condition where the electrode and the contact portion come into contact with each other and the contact portion is pressed toward the housing, and the contact portion is configured to move on and along a surface of the electrode with the second surface of the second portion in contact with the exterior surface as the contact portion is further pressed toward the housing.

11. The connector as claimed in claim 10, wherein the second portion is configured to be at a first position where the second portion is out of contact with the exterior surface before the electrode contacts and presses the contact portion, and to move from the first position to a second position where the second portion contacts the exterior surface in response to the electrode contacting and pressing the contact portion.

12. The connector as claimed in claim 10, wherein the first portion is bent to be deformable in the housing.

13. The connector as claimed in claim 10, wherein the first portion has resilience that works in a direction in which the first flat part and the second flat part face each other across the intermediate part.

14. A connector configured to make a contact with an electrical apparatus, the connector comprising:

a contact formed of a metal material; and a housing that is formed of an insulator and houses the contact, wherein the contact includes:

a housed part that is housed inside the housing, the housed part having a spring characteristic to serve as a spring in the housing, the housed part including:

a first flat part;

a second flat part substantially parallel to the first flat part; and an intermediate part extending obliquely between the first flat part and the second flat part, the intermediate part including a first end from which the first flat part extends and a second end from which the second flat part extends, the first end and the second end being bent in opposite directions; and an exposed part that is exposed outside the housing through an exterior surface of the housing, the exposed part including:

a contact portion configured to come into contact with an electrode of the electrical apparatus;

an end portion extending from the contact portion to define a free end of the contact;

an exposed portion extending from an end of the housed part to the contact portion; and a projecting part projecting from the exposed portion toward the exterior surface to be positioned between the contact portion and the exterior surface, wherein the end portion and the projecting part are positioned on opposite sides of the contact portion, the housed part is positioned across the exterior surface from the projecting part, the projecting part is configured to come into contact with the exterior surface when the electrode comes into contact with the contact portion so as to press the contact portion toward the exterior surface, and the contact portion is configured to move around points of contact of the projecting part and the exterior surface when the electrode further presses the contact portion toward the exterior surface while the projecting part is in contact with the exterior surface.

15. The connector as claimed in claim 14, wherein the projecting part projects from the exposed portion to have another free end positioned between the contact portion and the exterior surface.

16. The connector as claimed in claim 14, wherein the projecting part is configured to be at a first position where the projecting part is out of contact with the exterior surface before the electrode contacts and presses the contact portion, and to move from the first position to a second position where the projecting part contacts the exterior surface in response to the electrode contacting and pressing the contact portion.

17. The connector as claimed in claim 14, wherein the housed part is bent to be deformable in the housing.

18. The connector as claimed in claim 14, wherein the housed part has resilience that works in a direction in which the first flat part and the second flat part face each other across the intermediate part.

* * * * *